United States Patent [19]

Gemra

[11] Patent Number: 4,634,205

[45] Date of Patent: Jan. 6, 1987

[54] CONDUCTOR SPLICING DEVICES

[75] Inventor: Richard J. Gemra, Millington, N.J.

[73] Assignee: AT&T Technologies, Inc., Berkeley Heights, N.J.

[21] Appl. No.: 678,919

[22] Filed: Dec. 6, 1984

[51] Int. Cl.[4] ..... H01R 4/24

[52] U.S. Cl. ..... 339/97 P; 339/273 F; 24/136 R; 403/12

[58] Field of Search ..... 339/95 R, 97 R, 97 P, 339/98, 99 R, 273 R, 273 F; 24/136 R, 115 M; 403/12

[56] References Cited

U.S. PATENT DOCUMENTS

| | | | |
|---|---|---|---|
| 399,465 | 3/1889 | Bainbridge | 339/273 R |
| 2,828,147 | 3/1958 | Peiffer | 339/273 R |
| 3,249,908 | 5/1966 | Fuller et al. | 339/273 F |
| 3,458,780 | 7/1969 | McDaniel | 339/273 F |
| 3,858,957 | 1/1975 | Harwood et al. | 339/273 R |
| 4,451,104 | 5/1984 | Hodgson et al. | 339/98 |

FOREIGN PATENT DOCUMENTS

| | | | |
|---|---|---|---|
| 722584 | 1/1955 | United Kingdom | 339/273 R |

*Primary Examiner*—Joseph H. McGlynn
*Attorney, Agent, or Firm*—R. F. Kip, Jr.

[57] ABSTRACT

A device for splicing together aerial drop wires and comprising: (a) a housing shell having a throughpassage (b) a partition dividing such passage into two channels with outer ramp walls causing the channels to have respective wide openings at opposite ends of the passage and narrow openings at the other ends of the channels, (c) insulating piercing terminals projecting from the partition into these channels and adapted to electrically splice together conductor inserted through the narrow openings into the channels, and (d) wedges drivable through the wide openings to press the drop wires against the terminals and then squeeze the drop wires between the partition and the wedges, is characterized by the following improvements. The wedges are smooth surfaced on their sides which contact the drop wires. Different size wedges are provided to accommodate different size drop wires in the channels. Affixed to the partition are ribs projecting into the channels at their wide ends. The wedges have grooves adapted to snap fit onto the ribs to temporarily attach the wedges to the housing. The ribs are further adapted by bearing against shoulders on the wedges to provide a moisture seal and to increase the degree to which the device can withstand pulling force on the drop wires.

4 Claims, 16 Drawing Figures

CONDUCTOR SPLICING DEVICES

FIELD OF THE INVENTION

This invention generally relates to devices for splicing an electrical conductor, (comprising a wire or wires jacketed by insulation) by utilizing a wedge to cause electrically conductive terminal means to pierce such insulation and electrically contact such wire or wires and, thereby, to electrically connect such wire or wires with other electrical means. More particularly, this invention relates to devices of such kind which utilize a pair of such insulating-piercing terminals to electrically splice two electrical conductors together.

BACKGROUND OF THE INVENTION

In U.S. Pat. No. 4,451,104 issued on May 29, 1984, in the name of the inventor hereof and Sten E. Hodgson, to assignee hereof, and incorporated herein and made a part hereof by this reference, there is disclosed a device which is adapted for splicing together electrical drop wires. The device comprises: (a) a housing having a passage extending longitudinally therethrough, (b) a partition dividing such passage into two longitudinal through channels having laterally-inner walls provided by the partition and laterally-outer ramp walls at an acute angle to such inner walls so that the channels have respective wide openings at longitudinally opposite ends of the passage, and respective narrow openings at their other ends, (c) a pair of electrical connector members embedded in the partition and each having opposite ends projecting into respective ones of the two channels to provide therein respective terminals at an acute angle towards the channels' wide openings greater than that of the ramp walls, and (d) a pair of wedges drivable into the wide openings of the channels after drop wires have been inserted into the channels' narrow openings to extend past the terminals therein. In the use of the device, the wedges being driven into the channels first press the inserted wires against the terminals to cause the latter to pierce the wire insulation and electrically contact the wire cores therein. After the terminals have fully entered the drop wires, the wedges are driven further into the channels to squeeze the drop wires between the inner walls of the channels and the inner sides of the wedges to the end of securing the wires in the device so that the wires will not be drawn out of the device when pulling force is exerted on the wires.

While the wire splicing device just described is satisfactory in many respects, it has certain disadvantages of which an explanation of one is as follows.

In the course of driving the wedges into the channels, the wedges are constrained in their movements therein to follow the mentioned acute angle of the ramp walls. That is, the longitudinal and lateral displacements of the wedges in the channels will be in the same ratio as the longitudinal and lateral vector components of such acute angle. On the other hand, when the inserted drop wires are pressed by the wedges against the terminals, if these terminals are to pierce the wire insulation without tearing it, the longitudinal and lateral displacements of the drop wires must follow the acute angle which is made by the terminals and which, as stated, is greater than that of the ramp walls. In order to so follow such greater acute angle, longitudinal slip must occur between the drop wires and the wedge's inner sides which press against the wires. These inner sides, however, are disclosed in the mentioned '104 patent as having longitudinal distributions of teeth which are provided to prevent withdrawal of the wedges. Those teeth during the wire-against-terminal pressing phase bite into the insulation of the inserted drop wires. As a result, the wedges cannot readily slip longitudinally relative to the drop wires so as to permit them, when being pressed against the terminals, to follow the acute angles of those terminals. Hence, there is a tendency, during the entry of the terminals into the wires, for the wedges to longitudinally drag the drop wires along with them so as to cause the terminals to tear the wire insulation.

Moreover, after the terminals have fully entered the wires and the wedges are now squeezing the wires between themselves and the inner walls of the channels, such dragging tendency persists so as to produce the likelihood of further tearing of the wire insulation by the terminals.

SUMMARY OF THE INVENTION

The disadvantage outlined above is substantially obviated according to one aspect of the invention hereof by providing the improvement feature of, on the inner side of each wedge used in the device, a smooth surface which minimizes friction between the wedge's inner side and the electrical conductor pressed against a terminal by that side in the course of driving the wedge into the channel. By virtue of having such smooth surfaced inner side, the wedge is adapted during entry of the terminal into the conductor to partially slip longitudinally relative to the conductor so that, at one and the same time, the wedge in its longitudinal and lateral displacements can follow the acute angle of the ramp wall of the channel, and the conductor in its longitudinal and lateral displacements in such channel can follow the greater acute angle of the terminal piercing that conductor. Further, by virtue of the wedge having such smooth surfaced inner side, after the terminal has fully entered the conductor, and the wedge is now squeezing that conductor between the wedge's inner side and the channel's inner wall, the wedge is adapted to fully slip relative to the conductor so as to facilitate the keeping of the conductor stationary relative to the terminal entered therein and, thereby, to inhibit tearing by the terminal during such squeezing phase of the conductor's insulation. Such keeping of the conductor stationary is aided by the fact that the channel's inner wall, against which the conductor bears, has a non-smooth surface provided by a longitudinal distribution along such inner wall of teeth which bite into the conductor, such non-smooth surface being known per se from the mentioned '104 patent. Thus, according to the aspect of the invention being described, tearing of the conductor insulation by the piercing terminal is obviated or reduced during the squeezing phase by virtue of the conjoint effects on the conductor of the smooth surface of the inner side of the wedge and the non-smooth inner wall of the channel.

The invention is another of its aspects as characterized by the improvement feature of means adapted, once the wedge has been fully driven into the channel, for impeding withdrawal of the wedge from the channel in the presence of exertion on the conductor of a pulling force great enough to withdraw both the wedge and the conductor if such means were to be absent.

As a further aspect of the invention, it is characterized by the improvement feature of detent means permitting a wedge used in a wire splicing device to be snap-fitted to the housing of the device in a manner whereby the wedge can readily be detached from such housing preparatory to driving the wedge into a channel in the housing.

According to yet another aspect of the invention, it is characterized by the improvement feature of the use of wedges having different lateral spacings between the inner and outer sides thereof to facilitate accommodation in separate channels of the device of electrical conductors having different thickness.

As a still further aspect of the invention, the housing of the device may be a two-part housing comprising (a) a housing shell having formed therein a longitudinal passage with transversely-spaced lateral side walls and respective longitudinal grooves formed in such side walls, and (b) a longitudinal partition having transversely opposite sides received in such grooves and dividing such passage into separate laterally-spaced longitudinal through channels.

BRIEF DESCRIPTION OF DRAWINGS

For a better understanding of the invention, reference is made to the accompanying description of an exemplary embodiment thereof and the accompanying drawings wherein.

Figure 1:
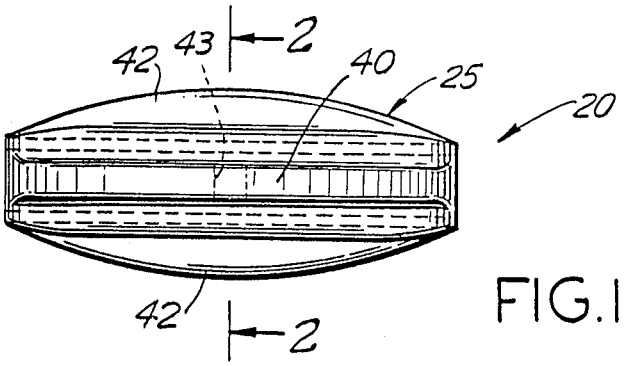
FIG. 1 is a plan view of the shell of the housing of such embodiment, a device for splicing together two aerial drop wires.

In the description which follows, counterpart elements are individually designated by the same reference numerals with different alphabetical suffixes, and it is to be understood that (a) the description of one such element shall, unless the description otherwise requires, be deemed to be also a description of all its counterparts, and (b) any such reference numeral for counterpart elements which lacks a suffix is a designation of all such elements.

Figure 2:
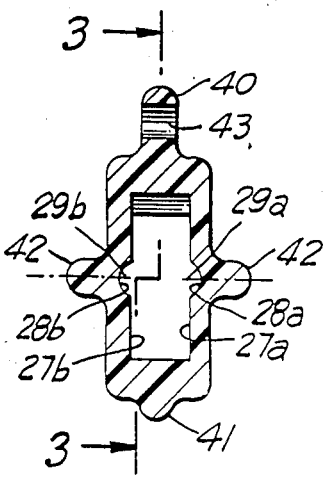
FIG. 2 is a right elevation in cross section, taken as indicated by the arrows 2—2 in FIG. 1, of the FIG. 1 shell.
Figure 9:
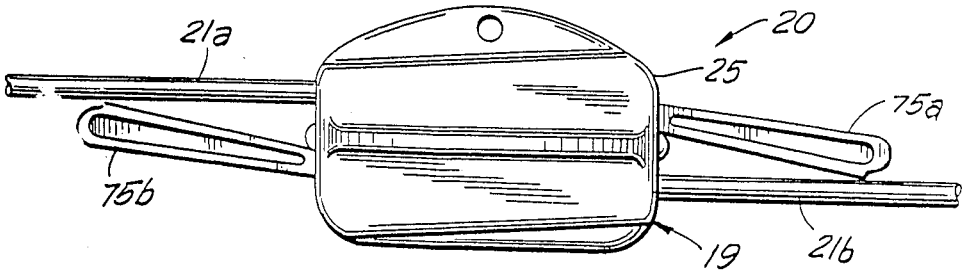
FIG. 9 is a front elevation of the assembled device at a stage in which electrical conductors in the form of aerial drop wires have been inserted into the device, but in which the wedges thereof have not yet been detached from the housing of the device so as to place the wedges in condition for driving them into the housing.

Referring now to FIG. 9, the reference numeral 20 designates a device for splicing together a pair of drop wires 21*a*, 21*b*. Device 20 comprises a housing 19 of which one part is provided by a shell 25 best shown in FIGS. 1–3.

Referring to those last named figures, shell 25 is an insulative molded plastic member made of, for example, a synthetic resinous material sold under the trade name ZYTEL ST 801 by the Dupont Company of Wilmington, Del. Shell 25 has formed therein a passage 26 extending longitudinally through the shell and bounded on its transversely opposite sides by laterally and longitudinally extending side walls 27*a* and 27*b*. Respectively formed in those side walls, in the laterally central region of passage 26, are two parallel grooves 28*a*, 28*b* which are arcuate in cross section, and are transversely opposite each other and extend longitudinally through passage 26 from end to end thereof. The center lines 29*a*, 29*b* for grooves 28*a* and 28*b* define the longitudinal ordinate for housing 23.

Passage 26 is bounded at its top and bottom by two laterally-spaced smooth-surfaced parallel planar walls 30*a*, 30*b* which are inclined at an acute angle A of about 4 degrees to the center lines 29 of the grooves 28. As later explained in more detail, such walls 30*a*, 30*b* form respective laterally-outer walls for a pair of channels 35*a*, 35*b* which are disposed on opposite lateral sides of the grooves 28 and extend longitudinally through shell 25, and which channels have, because of the inclination of walls 30, relatively wider respective openings at the longitudinally opposite ends of passage 26 and relative narrow openings at the other ends of such channels.

Shell 25 has on its exterior a relatively large top longitudinal ridge 40, a relatively small bottom longitudinal ridge 41 and two longitudinal side ridges 42 outside the grooves 28. The mentioned ridges tend to "streamline" the external shape of housing 19 and, particularly in the case of ridges 42, to reinforce the strength of that housing outside of the grooves 28. Ridge 40 has formed therein a clearance hole 43 permitting passage therethrough of a tie, nail or other fastener enabling device 20 to be secured in use to a tree, house, or other object to which it is desired to anchor the device.

Figure 3:
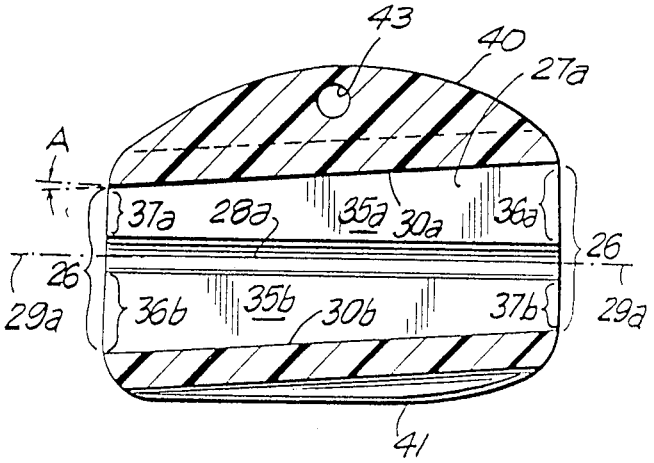
FIG. 3 is a front elevation in cross section, taken as indicated by the arrows 3—3 in FIG. 2, of the FIG. 1 shell.
Figure 4:
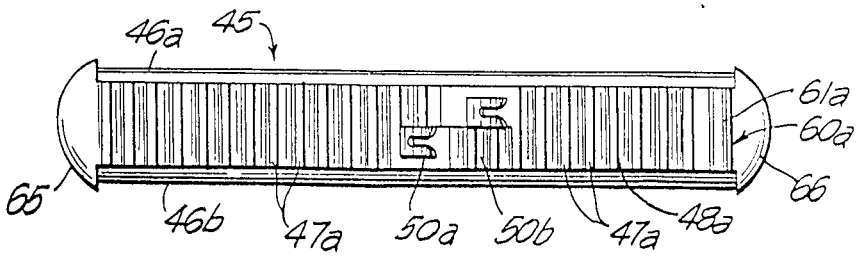
FIG. 4 is a plan view of a partition insertable into the FIG. 1 shell and forming another part of the housing of the mentioned device.
Figure 5:
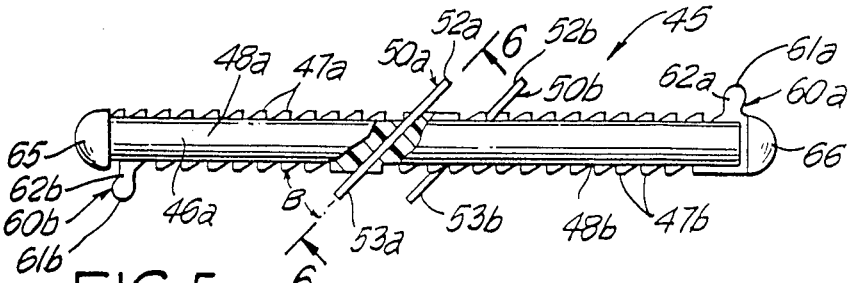
FIG. 5 is a front elevation of the FIG. 4 partition with a part of the partition being broken away to show in cross section the region of the partition in which is embedded one of the connector members of the mentioned device.

Referring now to FIGS. 4 and 5, another part of the housing 19 is provided by a insulative partition 45 made of synthetic resinous material sold under the tradename ZYTEL 185 BK by said Dupont Company. The partition has transversely-opposite sides 46*a*, 46*b* which are convex in cross section to match the concavity of grooves 28*a*, 28*b*, ans which are adapted to be seated in those grooves so as to divide the passage 26 through that shell into the mentioned two channels 35*a*, 35*b*, the top and bottom sides 48*a* and 48*b* of the partition providing the laterally inner walls for such channels. As indicated by FIGS. 4 and 5, such laterally-inner channel walls are non-smooth in the sense that they have longitudinal distributions thereon of teeth 47*a*, 47*b* extending transversely from side to side of the partition and forming at their tips a set of dihedral angles of which the planes which bisect those angles are at an acute angle to the wide openings 36 (FIG. 3) of the channels.

Figure 6:
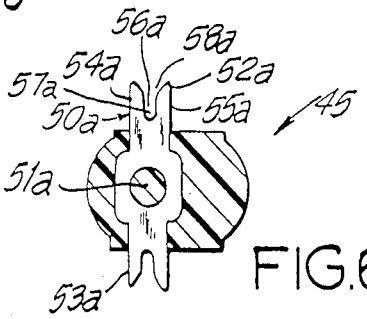
FIG. 6 is a cross sectional view, taken as indicated by the arrows 6—6 in FIG. 5, of one of such connector members.

Embedded in the partition 45 are two stiff electrical connector members 50*a*, 50*b* which may be stampings and are formed of an electrically conductive material such as copper-plated steel, and which are longitudinally offset from each other and, also, transversely offset from each other. Since the two members are duplicates in structure, only member 50*a* will be described in detail. As shown by FIG. 6, connector member 50*a* comprises a central portion 51*a* embedded in the material of partition 45 and, further, two regions 52*a*, 53*a* which are at opposite ends of the member, and which project laterally outward of the partition so as to provide in each of channels 35*a*, 35*b* an insulation-piercing terminal inclined to the inner wall of the channel at an angle B which, towards the channel's wide opening, is an acute angle greater in angular value than acute angle A made between the outer ramp wall of the channel and the inner wall thereof. Such angle B made by each of such terminals 52*a*, 53*a* may be, for example an angle of 45 degrees. Terminal 53*a* is a bifurcated terminal having two tangs 54*a*, 55*a* extending laterally outward to either side of a notch 56*a* therebetween. Notch 56*a* for the inward part 57*a* of its length is of constant width. At its outward ends, notch 56*a* is given a flared "V" mouth 58*a* by the shaping of the outer end of tangs 54*a*, 55*a*. Terminal 53*a* is similar to terminal 52*a*.

Figure 13:
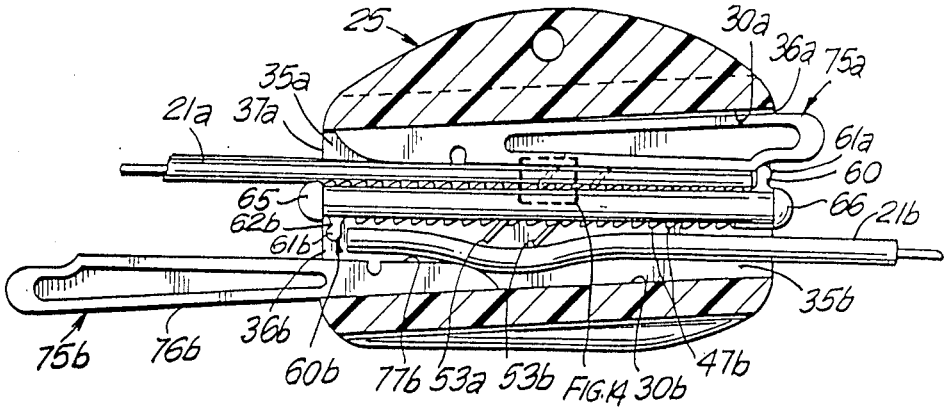
FIG. 13 is a front elevation in cross section of the FIG. 9 assembly, taken as indicated by the arrows 13—13 in FIG. 12 of the FIG. 9 assembly at a stage at which the aerial drop wires have been fully inserted into the housing and the right hand wedge has been fully driven thereinto, but the left hand wedge has not been driven into the housing of the mentioned device.

Coming now to some further details associated with partition 45, that partition at its right hand end has a stop means 60*a* integral with the rest of the partition so as to be affixed with housing 19, the stop means being laterally salient from the top side 48*a* of the main body of the partition above the level of the teeth 47*a* thereon so as to be adapted to laterally project into channel 35*a* adjacent to its wide opening 36*a* (see FIG. 13). Stop means 60*a* is in the form of a rib extending transversely across partition 45 and having at its outer end an enlarged head 61*a* (FIG. 10) joined by a web 62*a* to the main body of the partition. The surface 63*a* of head 61*a* conforms to a geometric circular cylindrical surface subtending a slightly greater angle than 180 degrees. The various functions adapted to be performed by rib 60*a* will be later explained fully.

Near its left hand end, partition 45 has thereon a stop means 60*b* similar to stop means 60*a* and having a head 61*b* and web 62*b* similar to those of the earlier described stop means. Rib 60*b* is salient from the bottom side 48*b* of the partition and is adapted to project laterally into channel 35*b* at its wide opening 36*b*.

Partition 45 has, at its longitudinally opposite ends, two end buttons 65, 66. As best shown by FIGS. 4 and 5, both end buttons are slightly enlarged relative to the main body of the partition between those buttons so that both such buttons in the lateral and transverse dimensions project in both directions slightly outward of that main body. Buttons 65 and 66 are, in the same fashion, enlarged relative to the shell grooves 28 (FIGS. 2 and 3) in which, as will now be described, the partition 45 is seated.

The shell and partition components 25 and 45 of the housing 19 are assembled together in the following manner. After the shell 25 has been molded and is still hot but is starting to cool, the lateral sides 27 of the passage 26 through the shell are, during the first part of the cooling, still capable of being flexed but, if left undisturbed, will bow in towards each other. Such bowing in of those walls would ordinarily be a serious disadvantage. In the instance, however, of manufacture of the present invention, that bowing-in action is turned to advantage.

As the shell 25 starts to cool and the passage walls 27 are starting to bow in toward each other, the end button 66 of partition 45 is inserted into the left hand end (FIG. 3) of passage 26 in alignment with the grooves 28 therein, and the partition 45 is then driven rightwardly into the passage. Since the shell walls 27 are still hot enough to be capable of being flexed outward, those walls are so flexed out by the passage between them of the rightward moving end button 66 until that button emerges from the right hand end of passage 26. Upon such emergence, the rightward movement of partition 45 relative to shell 25 is arrested so as to position the buttons 65, 66 longitudinally outward of, respectively, the left and right hand ends of grooves 28 to be separated from those grooves by either a no-clearance discontinuity or by a small longitudinal clearance. At the same time, the sidewalls 27 of shell 25 are released from the spreading effect thereon of a button 66 so as to snap back inwardly towards each other. In so doing, the grooves 28 in such walls close in around the transversely opposite rounded sides 46 of partition 45 so that those sides become fully seated in such grooves in firm contact with the concave bounding walls thereof. Once such snapping back occurs, further longitudinal movement of the partition in either direction relative to shell 25 is prevented by the bearing of one of the buttons 65, 66 against the adjacent end wall of shell 25 around the openings at that end of the grooves 28. From the description given, it will be evident that buttons 65, 66 perform the functions of (a) causing the snapping back of walls 27 to occur at the precise time that partition 45 is longitudinally centered within shell 25, and (b) thereafter preventing any significant longitudinal movement of the partition relative to the shell.

After the sides 46 of partition 45 have been seated as described in grooves 28, shell 25 continues to cool so that its walls 27 continue to tend to bow inwardly. Because of that inward bowing tendency, the partition 46 is pressed-fitted into grooves 28 so as to become secured with shell 25 almost as firmly as if the partition were to have been integrally molded with the shell. While the partition is so held in place by walls 27, the partition in turn acts as a spacer between those walls to prevent such walls from bowing in further during cooling and, thereby, become out of "true". Hence, the partition by its spacing effect assures that the fully cool walls 27 will be true and planar.

Figure 11:
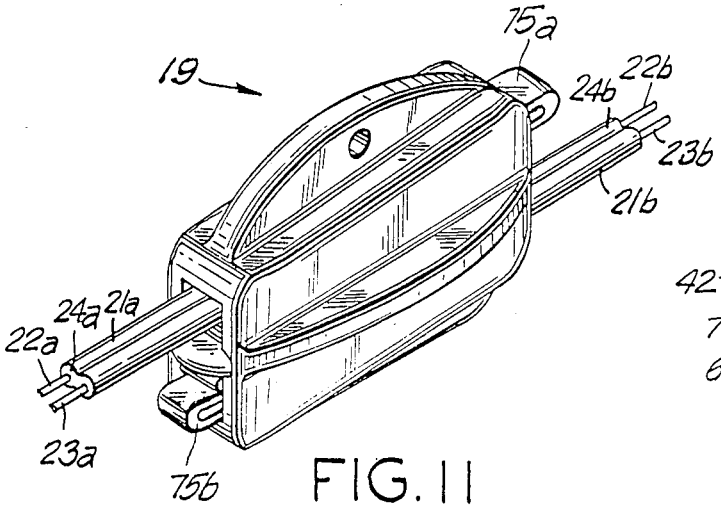
FIG. 11 is a perspective view of the FIG. 9 assembly at a stage thereof in which the aerial drop wires have been fully inserted into the housing of the assembly and the wedges have been fully driven into that housing.
Figure 12:
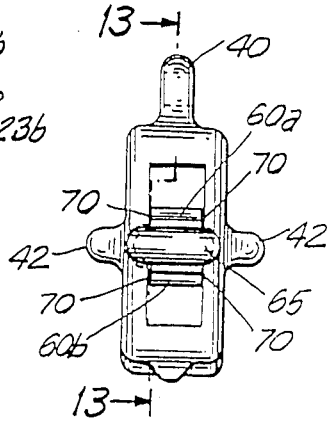
FIG. 12 is a left hand end view of the FIG. 9 assembly in circumstances where the aerial drop wires and the wedges have been removed so as to show primarily only the housing of the assembly.

Views of the complete housing assembly 19 are provided by FIG. 9 and FIGS. 11–13. Referring particularly to FIG. 12, it is to be noted that the transversely opposite ends of the stop ribs 60 on partition 45 are not fixedly joined to the side walls 27 of shell 25 but, instead, those rib ends are separated from those walls by discontinuities 70 so that the ribs are affixed to housing 23 only by virtue of being supported in cantilevered relation from partition 45. By virtue of ribs 60 having only such cantilever support, the outer ends for heads 61 of those ribs are resiliently deflectable longitudinally relative to the partition. Discontinuities 70 may take the form of small gaps between the opposite ends of ribs 60 and the walls 27. Preferably, however, discontinuities 70 are no-clearance discontinuities such that the transversely opposite ends of the stop ribs 60 slidably bear against the interior surfaces of the walls 27.

Figure 7:
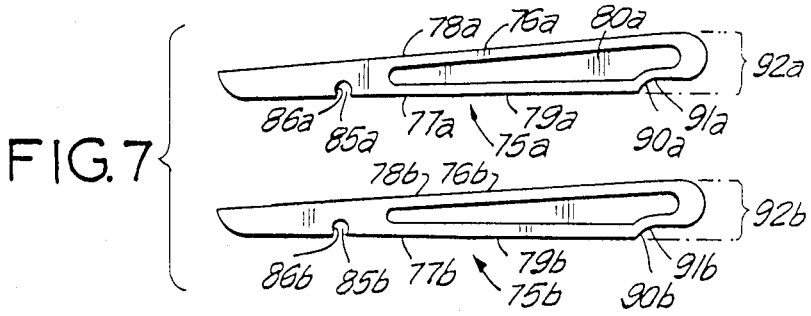
FIG. 7 is a front elevation of two larger size wedges adapted to be used with the mentioned device as parts thereof.

Device 20 includes not only housing 23 but also two wedges insertable or inserted into the channels 35*a*, 35*b* in that housing. FIG. 7 shows a pair of such wedges 75*a*, 75*b* which are duplicates of each other and which comprise wedge-shaped insulative members made of resinous material sold under the tradename ZYTEL 105 BK by said Dupont Company. Taking wedge 75*a* as typical, it has laterally-spaced inner and outer planar sides 76*a*, 77*a* of which the outer side is inclined to the inner one at an acute angle which is the same in angular value as the afore-described acute angle A existing between ramp walls 30 and groove center lines 29 and, therefore, also existing between those ramp walls and the channel inner walls 48*a*, 48*b* provided by the top and bottom sides of partition 45.

The surface 78*a* of wedge outer side 76*a* is smooth to or almost to a polish to reduce to a minimum the frictional resistance afforded thereby to movement of that surface over another surface. Similarly, the surface 79*a* of wedge inner side 77*a* is smooth to or almost to a polish to reduce in so far as possible the frictional resistance offered by that surface to sliding over an object in contact therewith.

The lateral sides of wedge 75*a* have formed therein two respective similarly shaped indentations of which the indentation 80*a* for the front lateral side is shown in FIG. 7. Those indentations render wedge 75*a* of "H" cross section in the transverse-vertical plane over the length of the wedge within with such indentations exist.

Figure 10:
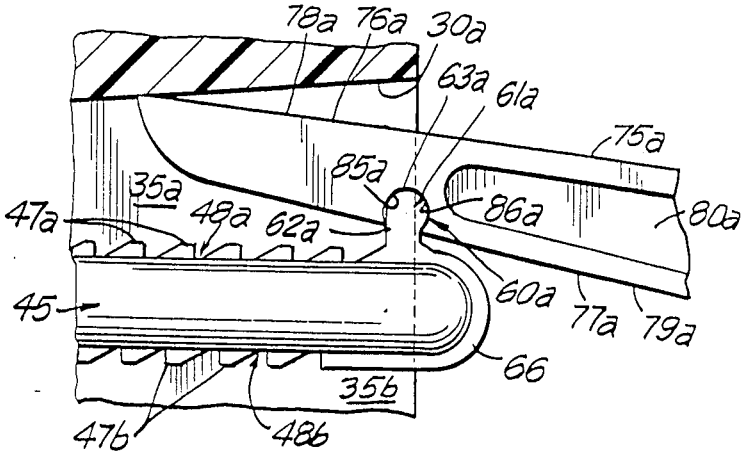
FIG. 10 is an enlarged fragmentary front-elevational view, partly in section, of a portion of the FIG. 9 assembly.

Wedge 75*a* has formed on its inner side and within the forward portion of the wedge a snap groove 85*a* extending transversely through the wedge and having an arcuate interior bounding wall 86*a* conforming to a geometric circular cylindrical surface subtending an angle of slightly greater than 180 degrees. That surface is defined by a radius of such value that groove wall 86*a* matches the circular cylindrical head 61*a* of rib 60*a* (FIGS. 5 and 10).

Wedge 75*a* also has formed therein, on its inner side at its back end, a rearwardly facing shoulder 90*a* of which the surface 91*a* is arcuate and conforms to a geometric circular cylindrical surface so as to likewise match with the circular cylindrical surfaces on the heads 61 of the stop ribs 60. The various purposes for which shoulder 90*a* is employed will be later described in more detail.

The inner and outer sides 76*a*, 77*a* of wedge 75*a* are separated by a lateral spacing 92*a* which may be, say, 0.285 inch, and which is of a value adapted to accommodate the insertion and securement within device 20 of drop wire of a type which is known as "F" drop wire, and which has a nominal thickness of insulation of 0.160 inch. Evidently, the value of such lateral spacing between the wedges inner and outer sides should vary inversely with the thickness of the drop wire to be secured within device 20 by that wedge, this being so because the channels 35 within device 20 cannot be adjusted in lateral width.

The wedge 75*b* of pair 75*a*, 75*b* has features which are duplicates of the already described features of wedge 75*a*, and which are identified by counterpart reference numerals.

Figure 8:
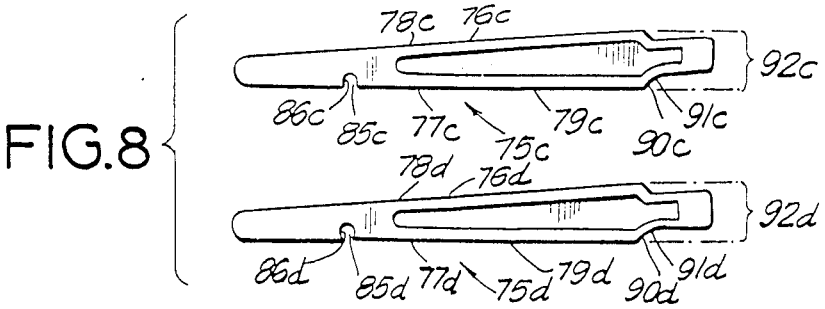
FIG. 8 is a front elevation of two smaller size wedges adapted to be used with the mentioned device as parts thereof.

Device 20 is supplied with a pair of wedges 75*c*, 75*d* which are in addition to the wedge pair 75*a*, 75*b*, and which are shown in FIG. 8. Wedges 75*c*, 75*d* have lateral spacings 92*c* and 92*d* between their inner and outer sides of a value which is less than the lateral spacing 92*a*, 92*b* between the inner and outer sides of wedges 75*a*, 75*b*, and which may be, say, 0.260 inch. Because of such lesser lateral spacing, wedges 75*c*, 75*d* are designed to secure within housing 19 the ends of aerial drop wires which are known as type "C" drop wires, and of which the insulation has a nominal thickness of 0.200 inch which is greater than that of type "F" drop wire. Except for the difference in lateral spacing between the inner and outer sides of, respectively, the wedges 75*a*, 75*b* and the wedges 75*c*, 75*d*, the wedges of pair 75*c*, 75*d* are (although of slightly different shape and size than the other wedge pair) substantial duplicates of each other and of the wedges 75*a*, 75*d*. Consonant with such duplication, the various features of wedges 75*c*, 75*d* which are counterparts of the features of wedges 75*a*, 75*b* are designated in FIG. 8 by counterpart reference numerals.

As disclosed in U.S. Pat. No. 4,451,104, the channels 35 in housing 23 are filled with a moisture proofing encapsulant (not shown) which may be, for example, a compound sold under the trade name of Solarite KM-2547 by the Solar Compounds Corp. of Linden, N.J.

As earlier stated, Device 20 is usable to splice together two electrical conductors in the form of aerial drop wires 21*a* and 21*b*. As best shown in FIG. 11, drop wire 21*a* comprises two spaced parallel electrically conductive wires or wire cores 22*a*, 23*a* and, also, insulation 24*a* jacketing such wires. Drop wire 21*b* is of similar construction. Either of drop wires 21*a* and 21*b* may be either a "C" type drop wire or an "F" type drop wire. If the drop wire is of the "C" type, one of wedges 75*c*, 75*d* is used to secure it in housing 19 and, if it is of the "F" type, one of wedges 75*a*, 75*b* is used for that purpose. Accordingly device 20 is adapted to splice together either two "C" drop wires or two "F" drop wires or one "C" drop wire and one "F" drop wire.

USE OF THE DEVICE

Device 20 is used in the following manner. Before the device is put into use two of wedges 75*a*–75*d* appropriate to the respective types of the two drop wires to be spliced together are, to avoid misplacement, releasably attached to housing 19 by snap fitting the groove 85 formed in each wedge onto the mating head 61 on the appropriate stop rib 60. Such snap-fitting is best shown in FIG. 10 wherein the snap groove 85*a* in wedge 75*a* is depicted as snap-fitted onto the head 61*a* of the rib 60*a*. If the respective types of the two drop wires to be spliced together are known beforehand, two wedges appropriate to the types of such two drop wires may be so attached to housing 19 as of the time device 20 is supplied to the user or earlier. If, however, that fact is not known beforehand, two appropriate ones of the four wedges supplied to the user may be releasably attached by that person to housing 19 preparatory to using the device and either as a precaution against misplacing the wedges or for purposes of preselecting for use a wedge or wedges matched to the type or types of drop wires to be spliced together. Prior to driving the wedges into the channels 35 in housing 19, the wedges are detached by the user from the housing by the exertion of moderate manual force which unsnaps the grooves 85 of the wedges from the heads 61 of the ribs 60. That detaching action may be performed either before or after the drop wires have been inserted into the channels in the housing.

FIG. 13 depicts device 20 when using wedges 75*a*, 75*b* to splice together two "F" drop wires 21*a*, 21*b*. As shown, the two drop wires are inserted into their respective channels 35*a*, 35*b* through the narrow openings 37*a*, 37*b* thereof and are moved forward in those channels until further such movement is stopped by the free ends of the drop wires coming into contact with the webs 62*a*, 62*b* of the stop ribs 60*a*, 60*b* at the wide openings 36*a*, 36*b* of such channels. In so being inserted into channels 35, the drop wires must slide over the teeth 47*a*, 47*b* on the channels' inner walls 46*a*, 46*b* and, also must pass by the terminals 52*a*, 53*a*, 52*b*, 53*b* projecting into those channels. The drop wires are, however, aided in so doing by the facts that both such teeth and such terminals slope in the direction of insertion movement of the drop wires to thereby reduce the resistance offered thereby to such movement.

Once the drop wires 21*a*, 21*b* have been fully inserted into channels 35*a*, 35*b*, the respectively associated wedges 75*a*, 75*b* are driven into such channels to secure the drop wires therein. An advantage of device 20 is that securement of the two drop wires may be done sequentially. That is, if desired, first one of the drop wires may be inserted in its channel and secured therein by driving of the associated wedge into that channel and, at a later time, the same may be done for the other drop wire. Also, whether or not only one or both drop wires have been inserted into their channels prior to the driving in of either wedge, the driving in of the two wedges can take place sequentially. FIG. 13 depicts a circumstance in which wedge 75*a* has already been fully driven into channel 35*a*, but wedge 75*b* has not yet been driven into channel 35*b*.

Consideration will now be given to what happens as, say, wedge 75*b* is driven into channel 35*b*. As the wedge advances, its inner side 76*b* comes into contact with the lower side of conductor 21*b* of which the upper side then either rests against terminals 53*a*, 53*b* or is brought to bear against those terminals by the wedge advance. At that point wedge 75*b* is positioned without clearance between conductor 21*b* and the ramp 30*b* provided by the outer wall of channel 35*b*, the outer side 76*b* of the wedge bearing flatly against that ramp. Because of such positioning without clearance, wedge 75*b* from that point on is constrained in its forward movement in channel 35*b* to slidingly bear flatly against ramp 30*b* as the wedge moves so that, accordingly, the wedge is constrained to follow the acute angle A at which ramp wall 30*b* is inclined to the longitudinal.

Figure 15:
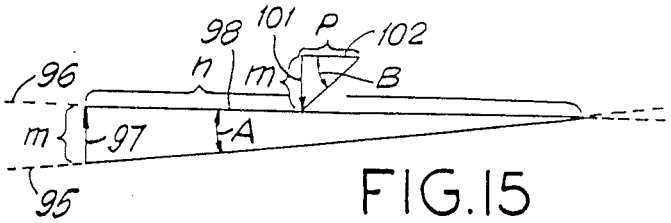
FIG. 15 is a geometric diagram showing various angular relations existing between elements of the FIG. 13 assembly.

Explaining the foregoing more fully by reference to FIG. 15, the angle A in that figure is shown as made between dash lines 95 and 96 which are parallel to, respectively, the ramp 30*b* and the inner wall 48*b* of channel 35*b*. Angle A may also be defined, however, by two vector components, namely a lateral vector component 97 with a magnitude m and a longitudinal vector component 98 with a magnitude n much greater than m, both such components being represented by solid line arrows. While the respective magnitudes of the components of angle A need have no fixed values, the ratio n/m of these magnitudes will have a constant value which is the tangent of angle A. As wedge 75*b* moves in channel 35 to force conductor 21*b* against terminals 53*a*, 53*b*, because the wedge bears flatly against ramp wall 30*b*, the longitudinal and lateral displacements undergone in that movement by the wedge will be constrained by that flat bearing to be in the same ratio n/m as are the magnitudes of the vector components 98 and 97 of angle A, and it is in this sense that such movement follows that angle.

As the wedge moves forward in channel 35*b*, its inner side 77*b* forces drop wire 21*b* against the terminals 53*a*, 53*b* to cause entry of the terminals into the insulation of that conductor. Terminals 53*a*, 53*b* are at an acute angle B which is much greater than angle A, and which, as shown in FIG. 15, can be defined by lateral and longitudinal vector components 101 and 102 of which component 101 is selected to have the same magnitude m as component 95 of angle A, and of which component 102 has a magnitude p. Vector components 101 and 102 are also the lateral and longitudinal displacement components of the extension into channel 35*b* of each of terminals 53*a*.

Now, as terminals 53*a*, 53*b* make contact with and then progressively enter further into the insulation 24*b* of conductor 21*b*, such terminals by virtue of being surrounded by such insulation will, absent tearing of the insulation, constrain the movement of the conductor being pierced by such terminals to follow the acute angle B in the same sense as wedge 75*a* is constrained to follow acute angle A. In other words, to avoid tearing of the insulation during such piercing action, the conductor 21*b* must undergo a longitudinal displacement p and a lateral displacement m having the same ration m/p as that of the vector components 101, 102 defining angle B, and conductor 21*b* does, in fact, undergo such displacements m and p so long as its insulation is not torn. Concurrently, wedge 75*b* of necessity undergoes a lateral displacement m since the conductor cannot be moved laterally by the amount m unless the wedge also moves laterally by that amount. Under the described constraints, however, on the movements of the conductor and the wedge, the lateral displacement m of each of the conductor and wedge must be accompanied by a longitudinal displacement p of the conductor and a longitudinal displacement n of the wedge. But, as shown by FIG. 15, there is a large difference between these two displacements in that wedge displacement n is much greater than conductor displacement p.

The anomaly just described is resolved by having the inner side 77*b* of wedge 75*b* be a smooth surface 79*b* as earlier described herein. By virtue of having that smooth surface, the inner side 77*b* of the wedge is enabled to move easily longitudinally relative to conductor 21*b* while in friction contact therewith so, that as the conductor undergoes its displacement p, the wedge partially slips longitudinally relative thereto by the amount n-p. In this way, the wedge and the conductor can concurrently undergo their respective constrained movements although the two movements are different. If there was no such slip enabled by smooth surface 79b, the wedge would drag the conductor along with it through the full longitudinal displacement n of the wedge with resulting intolerable ripping and tearing of the insulation of the conductor.

In such connection, it might be thought by such tearing could be avoided by inclining the terminals 53a, 53b to be at the same acute angle to the longitudinal as the ramp 30b. To do so, however, would be impractical since the ramp angle is only about 4 degrees, and if the terminals were to be at that angle, they could not readily pierce the insulation of drop wire 21b and/or would have to be so long as to be easily subject to column bending so as to be unable on that account to penetrate far enough into the insulation to make electrical contact with the conductor wires 22b, 23b. At the other extreme, if terminals 53a, 53b were to be normal to the longitudinal, terminal 53a would have a tendency to catch the free end of the conductor 21b during its insertion into channel 35b so as to prevent passage of the conductor past the terminal. Moreover, the terminal would be subject to maximum bending of the cantilever beam deflection type during driving of wedges 75 into the channel. The shown inclination of terminals 53a, 53b at an angle of about 45 degrees thus represents an optimal compromise between those two extremes in that it avoids or reduces the disadvantages of each.

Figure 14:
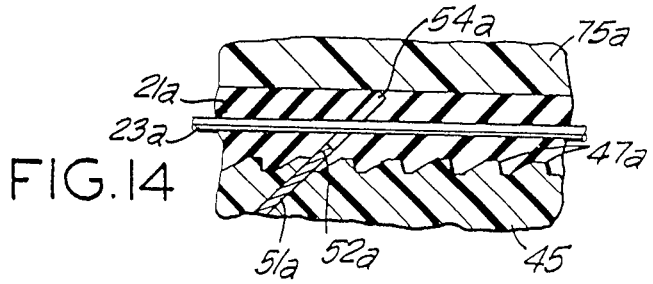
FIG. 14 is an enlarged fragmentary cross sectional view of a region of the mentioned device as shown in FIG. 13, FIG. 14 showing piercing of one of the drop wires by a terminal of one of the connector members of the mentioned device.

The first "pressing" phase of securement of conductor 21 in housing 19 is accomplished by the action described above in which wedge 75b presses conductor 21b against terminals 53a, 53b to produce full entry thereof into the conductors so that the wires 22a, 23a thereof become received in the notches of the corresponding terminals and bear against the tangs thereof to make electrical contact with the terminals. Such contact condition is shown in FIG. 14 for conductor 21a, terminal 52a and wire 23a in that conductor. That first phase ends when the conductor is forced into firm contact with the inner wall 48 of the channel 35 into which the conductor is inserted.

At that point, the mentioned first phase is succeeded by a second "squeezing" phase of securement in which, say, the conductor 21b is squeezed between the inner side of wedge 75b and the inner wall of channel 35b as the wedge is driven further into the channel. During such second phase, the lateral force exerted by the wedge on the conductor increases at a much faster rate than it did during the first phase when such force was used only to cause piercing of the conductor insulation by the channel terminals. Accordingly, during such second phase, there is a heightened tendency for the wedge in its driving into the channel to drag the conductor along with it and thereby cause the terminals to produce a tearing of insulation which can only be avoided by having the conductor remain longitudinally stationary relative to those terminals. Such insulation tearing during the second phase is, however, avoided in the following ways. First, the entered terminals themselves offer resistance to movement relative thereto of the conductor. Second, the smooth surface 79b on the inner side of wedge 75b promotes longitudinal slippage of the wedge relative to the conductor. Third, the non-smooth surface provided by the teeth 47b on the inner wall 48b of channel 35b offer substantial frictional resistance to longitudinal movement relative thereto of the conductor 21b under the circumstances then obtaining of the conductor being in forcible contact with those teeth. Accordingly, the smooth surface 79b of wedge 75b and the non-smooth surface 47b of the inner wall of the channel cooperate to keep stationary longitudinally the conductor 21b relative to the terminals 53a, 53b. The result is that there is substantially full longitudinal slippage between the wedge and the conductor, substantially no longitudinal slippage between the conductor and the channel inner wall and, hence no relative movement between the conductor and the terminals, and no significant tearing, accordingly,by the terminals of the insulation of the conductor.

The second phase of securement of the conductor in housing 19 ends when the wedges 75 have been driven into channels 35 as far as they can go by the exertion on the wedges of manually produced driving force. FIG. 13 shows such fully in-driven condition for wedge 75a. In the course of driving that wedge into channel 35a, a point will be reached on the wedge at which its lateral thickness between its inner and outer sides becomes equal to the normal lateral distance of separation of head 61a of stop rib 60a from ramp wall 30a when that rib is not resiliently deformed. Thus, for the progressively greater wedge thicknesses rearward of that point to get past head 61a, it is necessary for the wedge to be forced past the head, and for there to be a resilient deformation of some part of device 20 which increases. the separation distance of the head from the ramp wall to the extent necessary to accommodate those greater wedge thicknesses. The increase of such distance is conveniently effected in the disclosed device by a resilient longitudinal deflection forward and downward of the outer end of stop rib 60a, which end can so deflect because the cantilever support given that rib by partition 45 permits it to do so, and because the rib is not constrained from so deflecting by being fixedly joined at its transversely opposite ends to the lateral side walls 27 bounding channel 35a. There are, however, other alternatives not disclosed in detail herein for providing the resilient deformation which will enable wedge 75a to be driven in past head 61a after the mentioned point has been reached. For example, the lateral channel walls 27 may be designed to resiliently stretch or to resiliently deflect so as to allow wedge 75a to pass for the required longitudinal distance past head 61a. As another example, the grooves 28 in channel walls 27 and in which partition 45 is seated may be shaped to have longitudinally opposite end sections which are flared to permit the end portions of partition 45 in those sections to resiliently deflect within those grooves in the spacing provided by such flaring and in the proper direction to increase the distance of separation of the heads 61 of stop ribs 60 from the ramp walls of the channels in which those ribs are located.

The described forced passage of wedge 75a past rib head 61a with accompanying resilient deformation of rib 60a is ended when the inward driving of the wedge positions the shoulder 90a thereon just forward of such head. Rib 60 is thereupon relieved of the deflecting force thereon and, accordingly and because of its resilience, springs back to return head 61a to its normal undeflected position. At that position, head 61a is disposed in the withdrawal path from channel 35a of the shoulder portion of wedge 35a, a matter later discussed herein more fully. Wedge 75a may be driven and kept in far enough to produce a separation between its shoulder 90a and the head. Preferably, however, either by driving the wedge in just the right amount or by slight withdrawal of the wedge after it has been driven in to position its shoulder forward with a spacing from the head, the shoulder 90*a* is brought to bear against the rib head 61*a* so that circular cylindrical surface 91*a* of the shoulder mates with and makes firm areal contact with the circular cylindrical surface on head 61*a*. To do so is advantageous because such contact between those two surfaces produces a partial seal against entry into the terminal region of channel 35*a* of moisture which might deleteriously affect the electrical contacts made in that channel between the terminals therein and the wires of the conductor therein. The partial sealing against entry of such moisture is further promoted by having the discontinuities 70 (FIG. 12) between the transversely opposite ends of ribs 60*a* and channel walls 27 be of such character that, as earlier described, those ends contact and slidably bear with zero clearance against those walls so that there is no inward leakage of moisture between such ends and walls except for the minimal leakage unavoidably occurring because of the inherent imperfection of fit therebetween.

Consideration will now be given to another function performed by the stop ribs 60 of device 20.

When wedge 75*a* is fully driven in (as shown in FIG. 13) the conductor 21*a* squeezed thereby exerts on the wedge a substantial lateral reactive force $F_e$ which is converted by ramp wall 30*a* into a longitudinal force component $F_g$ tending to eject the wedge from channel 35*a*. Such ejection will not occur, however, even in the absence of rib 60*a* because the acute angle A of the ramp wall 30*a* is less in angular value then the angle of slip between the smooth surface of ramp wall 30 and the smooth surface 78*a* on the outer side of the wedge. Such angle of slip is the angle of which the tangent is equal to the coefficient of friction of these two surfaces and is, accordingly, the threshold angle at which lateral upward force on the wedge can generate a longitudinal force component $F_g$ great enough to overcome the longitudinal friction force $F_h$ between these two surfaces opposing relative sliding therebetween and consequent rearward movement of the wedge. It follows that, even without stop rib 60*a*, the longitudinal friction force $F_h$ will be equal and opposite to $F_g$, and wedge 75*a* will not slip rearward so long as there is no pulling force W on conductor 21*a*. Incidentally, to have angle A such a small angle is advantageous not only for the reason just stated but also for the reason that, the smaller such angle, the greater is the effect of wedge 75*a* in multiplying the longitudinal driving force into a much larger inward lateral force for the purpose of first pressing and then squeezing the conductor 21*a* and, also, for the purpose of giving the outer end of rib 60*a* an inward component of resilient deflection as described above.

Figure 16:
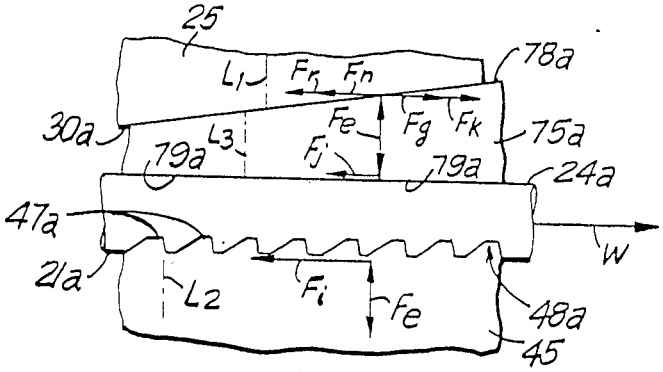
FIG. 16 is a diagram illustrative qualitatively of forces generated the mentioned device during its use, the magnitudes of the arrows representing such forces not being necessarily to scale.

Assume now that with wedge 75*a* being held in place as shown in FIG. 13, that, as shown in FIG. 16, a pulling force W of increasing value is applied to conducter 21*a* to tend to draw it rightward out of housing 19. Assume also, to begin with, that the rib 60*a* is absent.

Pulling force W is opposed by the sum of two forces tending to hold conducter 21*a* in place. The first of these holding forces is a static friction force Fi generated between conductor 21*a* and the non-smooth surface 47*a* of the partition wall 48*a* against which the conductor is squeezed. Force Fi equals the force Fe multiplied by the coefficient of friction ("COF") between the conductor and that surface. The second of these holding forces is a static friction force Fj generated between conductor 21*a* and the wedge surface 79*a* against which the conductor is squeezed. Force Fj, equals the force Fe multiplied by the coefficient of friction between the conductor and that wedge surface.

Initially, as force W increases, forces Fi and Fj likewise increase (with the value of Fj maintaining a fixed proportional relation to that of Fi) so that their sum, Fi and Fj, stays equal to W so as to keep the conductor 21*a* stationary. As forces Fi and Fj so increase, their values approach closer to respective slip limits L2 and L3 of which each is the limiting value the corresponding static friction force can attain, and which limiting value occurs just before there is interruption of the static friction bond between the contacting surfaces generating the force, slip thereafter occurring between these two surfaces. So long as two such static friction forces Fi and Fj oppose pulling force w, and neither of such forces individually exceeds its slip limit, conductor 21*a* can be maintained stationary in housing 19 for values of W which exceeds one of these slip limits. For example, the conductor can be held in place for values of W exceeding L2.

In connection with force Fj, however, the following problem arises. With stop rib 60*a* being absent, in order for wedge 75*a* to generate without slipping the force Fj between its bottom surface 79*a* and the conductor, the top surface 78*a* of the wedge must exert on the outer channel wall 30*a* an active force having a longitudinal component Fk which is equal and opposite to Fj, and which is superposed with the previously discussed force Fg tending to produce ejection of the wedge because of the inclination of the ramp wall. To prevent slippage, however, between wedge surface 78*a* and ramp wall 30*a*, the force Fk must be counterbalanced by an equal and opposite friction force Fr which is generated between that surface 78*a* and ramp wall 30*a*, and which force Fr is superposed with the previously discussed friction force Fh generated between those surfaces to neutralize the ejection force Fg.

Now, postulating the slip limit for all static friction forces between surfaces 78*a* and 30 as being L1, as the pulling force W increases and force Fr commensurately increases, the combined force Fr and Fh is given a "head start" in reaching limit L1 by virtue of the fact that force Fr is superposed on already existing force Fh. That is, as W increases the combined force Fr and Fh reaches L1 sooner than if there were no need for the force Fh to be present to neutralize wedge ejection force Fg (a situation which could occur only in the impractical case of the ramp angle A being zero). When, however, the combined force Fr plus Fh reaches L1, there occurs between surfaces 30*a* and 79*a* a condition of potential slip causing forces Fr and Fj to undergo a sharp drop which will be assumed (for simplicity of analysis) as being down to zero value for these forces (i.e., any low remaining dynamic friction force between surfaces 78*a* and 30*a* will be ignored). That sharp drop in turn, however, causes the forces opposing the pull on conductor 21*a* by force W to change from the combination of forces Fi to Fj to the force Fi along. It follows that, if W is then greater than L2, both the conductor 21*a* and wedge 75*a* will be pulled out of housing 19 by force W. Also, even if the force W is then less than L2, as W increases, it will reach the point of pulling out the conductor sooner than if both of forces Fi and Fj were opposing W.

Thus, it will be clear that, in the absence of stop rib 60*a*, the wedge ejection force Fg restricts the degree to which the described device 20 can withstand pulling force on conductors spliced thereby so as to preclude the pulling out therefrom of such conductors.

The providing of the stop ribs 60*a*, 60*b* as parts of such device overcomes the problem just discussed. More specifically and considering particularly the stop rib 60*a*, when the shoulder 90*a* of wedge 75*a* bears against that rib, the force Fg is transmitted to the rib which opposes it by an equal and opposite reactive force in effect neutralizing the force Fg. That is, it is now the rib 60*a* rather than the friction bond between surfaces 78*a* and 30*a* which absorbs the force Fg. This being so, such friction bond can become devoted solely to the purpose of generating (as W increases) the friction force Fr between these surfaces necessary to generate the force Fj opposing W. This means, in turn, that the ability of device 20 to withstand pulling out therefrom of conductors spliced thereby will not be limited by a "premature" reaching (as earlier described) of the slip limit L1 by the friction force developed between ramp wall 30*a* and wedge surface 78*a*.

The stop ribs 60*a* and 60*b* are thus effective in increasing the amount by which device 20*a* can withstand pulling force on electrical conductors spliced thereby. Indeed, it has been found that by providing rib 60*a* or equivalent stop means, conductor 21*a* can withstand a pulling force of 400 pounds or more without being drawn out of device 20. Evidently, however, stop ribs 60*a*, 60*b* are also effective in keeping the wedges 75*a*, 75*b* in place in housing 19 when, even in the absence of pulling force on the conductors, the wedges themselves are subjected to pulling forces which would tend to draw them out of the housing.

The foregoing exposition relating to FIGS. 15 and 16 sets out what are believed to plausible explanations of how the disclosed device 20 operates. It is to be understood, however, that applicant does not intend to be bound by such explanations, and that the invention hereof does not depend on the extent of accuracy of such explanations.

The foregoing description relating to the use of wedge 75*b* or to the use of wedge 75*a*, as the case may be, is equally applicable mutatis mutandis to the use of the other of such wedges or to either of wedges 75*c*, 75*d*. When both of wedges 75*a* and 75*b* are fully driven into housing 19 as shown in FIG. 13 only for wedge 75*a*, the respective wires 22 of the two conductors 21 will be electrically spliced together by the electrical connector 50*a* and the respective wires 23 of such two connectors will be electrically spliced together by the electrical connector 50*b*.

Referring to FIGS. 3 and 4, shell 25 and partition 45 have respective end-to-end longitudinal dimensions of, respectively, 2.500 inches and 2.785 inches, and other dimensions of housing 19 are shown in those figures to scale. Referring to FIGS. 7 and 8, wedges 75*a*, 75*b* and wedges 75*c*, 75*d* have end-to-end longitudinal dimensions of, respectively 2.75 inches and 2.63 inches and the other dimensions of those wedges are shown in scale in the latter figures.

The above-described embodiment being exemplary only, it is to be understood that additions thereto, omissions therefrom and modifications thereof can be made without departing from the spirit of the invention. For example, the invention is applicable to devices for splicing together electrical conductors comprising only one wire or wire core jacketed by insulation. Moreover, the invention is applicable to devices in which only one electrical conductor is electrically spliced by insulation-piercing terminal means to other electrical means which can be other than an electrical conductor. The stop means disclosed herein for wedges may be other than as specifically described. Thus, for example, although not preferred, such stop means may comprise set of teeth distributed along, respectively, the ramp wall of a channel and the wedge surface contacting that wall, the teeth in such sets being inclined from the normal to the surfaces on which such teeth are formed so as to offer no significant opposition to driving the wedge into the channel but to thereafter substantially impede its withdrawal from the channel.

Accordingly, the invention is not to be considered as limited save as is consonant with the scope of the following claims.

What is claimed is:

1. The improvement in a device for making an electrical connection to an electrical conductor comprising at least one wire jacketed by insulation, in which said device comprises:

(a) an insulative housing having formed therein a longitudinal through channel bounded on laterally opposite sides thereof by a backing wall and by a ramp wall at an acute angle to said backing wall so that said channel at its longitudinal opposite ends of said ramp wall is relatively wider and narrower, (b) an electrical insulation-piercing terminal projecting from said backing wall into said channel, (c) conductive means for connecting said terminal to other electrical means, and.

(d) a wedge drivable into said channel through its opening for the wider part thereof so as to produce piercing by said terminal of the insulation of said conductor when inserted into said channel through the opening for the narrower part thereof and, thereby, the making of electrical contact between said terminal and said wire, and in which said improvement comprises:

(e) a transverse rib which is longitudinally spaced away from said terminal towards said opening, and which laterally projects from said backing wall into said channel, said rib being supported in cantilevered relation from said backing wall so that the outer end of said rib is resiliently deflectable longitudinally and inwardly relative to such wall, and (f) a rearwardly facing shoulder formed on the inner side of said wedge adjacent the back end thereof, (g) said wedge being drivable into said channel to position said shoulder forward of said rib, and said shoulder being thereafter adapted by contact with such rib to impede withdrawal of said wedge from said channel.

2. The improvement according to claim 1 in which said rib comprises:

(i) an enlarged head at the outer end of the rib, and (ii) a web joining such head to said partition, and in which said wedge has formed therein a snap groove adapted to snap fit onto the head of the rib so as attach such wedge to said partition in a manner permitting detachment of the wedge from the rib preparatory to driving the wedge into said channel.

3. The improvement in a device for making an electrical connection to an electrical conductor comprising at least one wire jacketed by insulation, in which said device comprises:

(a) a housing having formed therein a longitudinal through channel bounded on laterally opposite sides thereof by a backing wall and by a ramp wall at an acute angle to said backing wall so that said channel at longitudinally opposite ends of said ramp wall is relatively wider and narrower, (b) an electrical insulation-piercing terminal projecting from said backing wall into said channel, (c) conductive means for connecting said terminal to other electrical means, and (d) a wedge drivable into said channel through the opening for the wider part thereof so as to produce piercing by said terminal of the insulation of said conductor when inserted into said channel through the opening for the narrower part thereof and, thereby, the making of electrical contact between said terminal and said wire, and in which said improvement comprises:

(e) detent means comprising first and second detent elements on, respectively, said housing and said wedge, said detent elements being snap-fittable together to releasably attach said wedge to said housing while permitting detachment of said wedge from said housing preparatory to driving said wedge into said channel.

4. The improvement according to claim 3 in which said first detent element comprises a transverse rib laterally projecting from said backing wall into said channel, said rib having at its outer end an enlarged head and having, also, a web joining said head to said backing wall, and in which said second detent element comprises a transverse snap groove formed in the inner side of said wedge and adapted to snap-fit onto said head.

* * * * *